United States Patent [19]

Reustle

[11] 4,153,168

[45] May 8, 1979

[54] AUTOMATIC HOPPER DOOR OPENER

[76] Inventor: Walter C. Reustle, 4824 Valley View Ct., Dunwoody, Ga. 30338

[21] Appl. No.: 837,939

[22] Filed: Sep. 29, 1977

[51] Int. Cl.[2] ..... B61D 7/08

[52] U.S. Cl. ..... 414/786; 105/241 R; 414/402; 414/387

[58] Field of Search ..... 214/58, 63, 152; 105/241 R, 241 C, 239, 240

[56] References Cited

U.S. PATENT DOCUMENTS

| | | | |
|---|---|---|---|
| 3,041,448 | 6/1962 | Pascoe et al. | 214/58 |
| 3,072,074 | 1/1963 | Lunde et al. | 91/414 |
| 3,173,381 | 3/1965 | Charles et al. | 105/250 |
| 3,188,980 | 6/1965 | Tearpock et al. | 105/245 |
| 3,295,704 | 1/1967 | Gillick et al. | 214/58 |
| 3,404,650 | 10/1968 | Miller et al. | 105/250 |
| 3,433,373 | 3/1969 | Carey et al. | 214/63 |
| 3,446,373 | 5/1969 | Keister, Jr. et al. | 214/63 |
| 3,596,565 | 8/1971 | Atkinson | 91/411 R |
| 3,730,360 | 5/1973 | Aquino et al. | 214/63 |
| 3,828,948 | 8/1974 | Peterson | 214/63 |

*Primary Examiner*—Lawrence J. Oresky
*Attorney, Agent, or Firm*—Jones, Thomas & Askew

[57] ABSTRACT

The automatic controlling of a hopper door of a moving dump vehicle is actuated in sequence by a wayside mechanical trip and subsequently by a wayside inductive signal. An automatic preliminary check is made of the control system immediately upon actuation by the wayside mechanical trip to detect proper or improper setting of the portion of the control system which responds to the wayside inductive signal, and if an improper setting is detected, the control system is disarmed to avoid prematurely dumping the load from the vehicle.

2 Claims, 3 Drawing Figures

NORMAL
REVERSE
MAIN AIR
MAIN AIR
MAIN AIR
AIR VOLUME
EX A
EX B
EX C
G
V
CK

NORMAL
REVERSE
MAIN AIR
MAIN AIR
MAIN AIR
AIR VOLUME
EX B
EX C
EX A
V
CK
G

AUTOMATIC HOPPER DOOR OPENER

BACKGROUND

1. Field of the Invention

This invention, for purposes of this disclosure, pertains to a railway hopper car automatic discharge control system.

2. Description of the Prior Art

The existing prior art disclose systems for automatically opening and closing hopper doors of railroad cars whereby the bottom dump doors are opened and closed by pistons operated by a pneumatic control system. The pneumatic control systems usually are powered by the main air supply system of the towing vehicle, by diverting the flow of air pressure from the main air system to the pneumatic control system. This diversion of airflow usually has been accomplished by the engineer or some other person opening a valve in an air line which connects the main air supply to the pneumatic control system. Once the air has entered the pneumatic control system, various piping techniques have been used to direct the flow of air pressure to one side or the other of the dump door control system. The most common means of changing the air flow from one side of the dump door system to the other side is by using solenoid operated directional control valves.

SUMMARY OF THE INVENTION

The present invention is a combination of elements and procedural step which form a novel automatic fail safe dump door control system. The entire dumping system is automatic, that is, there need be no human involvement in nor concern for the proper operation of the dumping system. The steps performed by the system include automatically connecting the pneumatic control system to the main air supply with or without intervening reservoir systems, thus charging the system, and likewise automatically cutting off air supply to the control system upon detecting an improper condition in the system that might result in a premature dumping of the load from the dump vehicle. There are no protruding arms or other pieces which must be raised out of the way of possible obstacles such as in the prior art. This is due to the automatic reset feature of the present invention by which the protruding trip arm is automatically returned to its untripped position if it is accidentially tripped. Furthermore, the present invention provides an automatic preliminary pneumatic check of the operation readiness of the control system and equipment.

It is an object of this invention to accomplish the opening and closing of hopper car doors automatically, therefore avoiding the possibility of human error and the need for human involvement or concern.

It is also an object of this invention to provide each hopper door vehicle with an independent, self-contained control system which will accomplish the opening and closing of hopper car doors without requiring the use of any external power supply nor the use of connecting wires or special piping between adjacent vehicles.

Another object of the present invention is to accomplish the opening and closing of hopper car doors by using a control system in which all electrical control equipment is solid state and in which no relay or controller contacts are used.

These and other objects of the invention will become apparent from reference to the following description, attached drawing and appended claims.

DETAILED DESCRIPTION OF THE INVENTION

Figure 1:
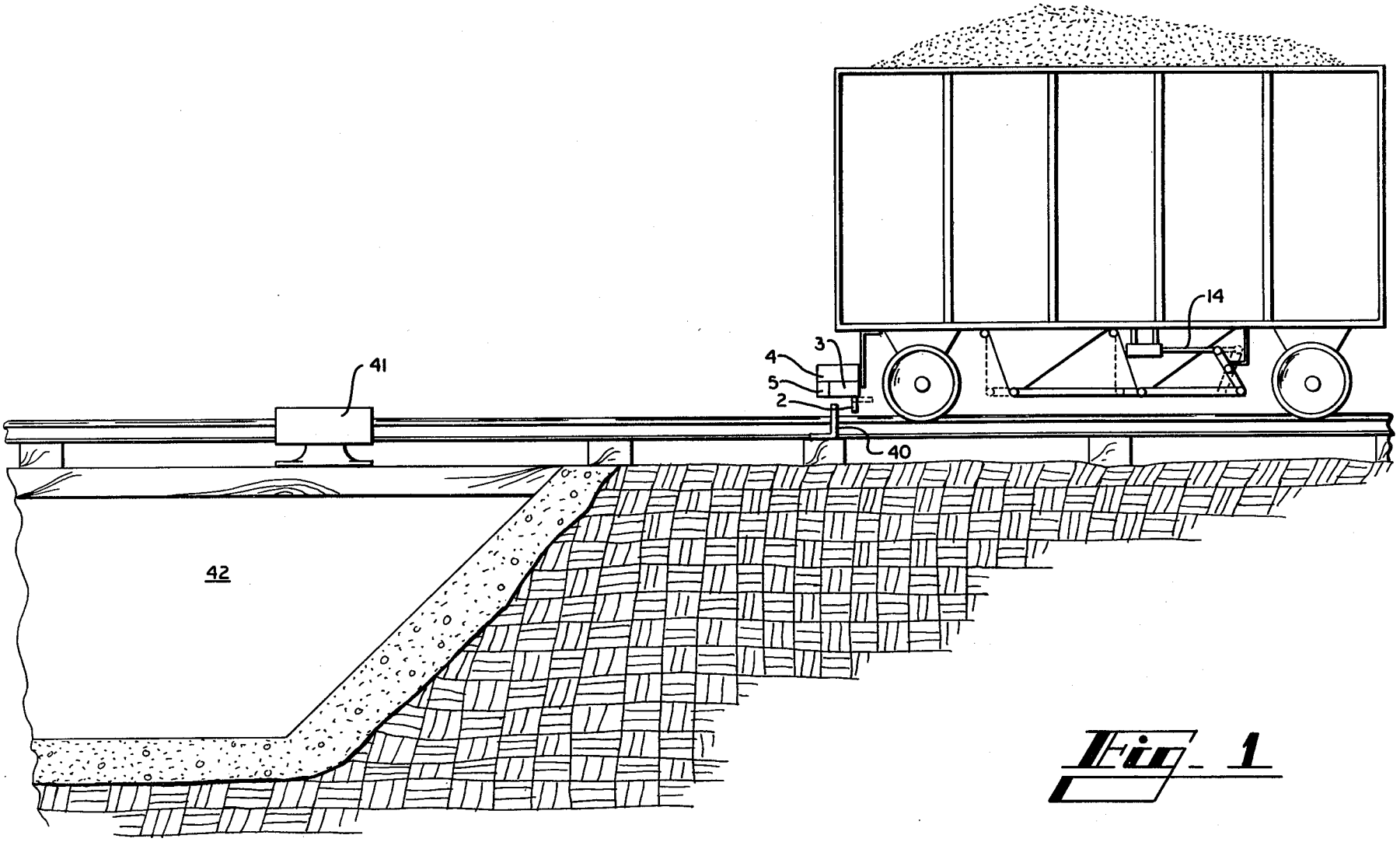
FIG. 1 is a partial side elevational view showing a vehicle outfitted with the present invention and showing the wayside triggering devices of the system.

Referring now to the drawings in which like components have like numerals and in which, for this description, "main air" means a connection to the main air supply and the "Ex" means exhaust, FIG. 1 shows the positioning of the components of the present invention on the underside of a railway hopper car. The trip arm 2 and trip arm release valve assembly 3, pneumatic control system 4 and inductive pick-up coil 5 can be mounted in a single housing 1 on the bottom side of the hopper vehicle.

Figure 2:
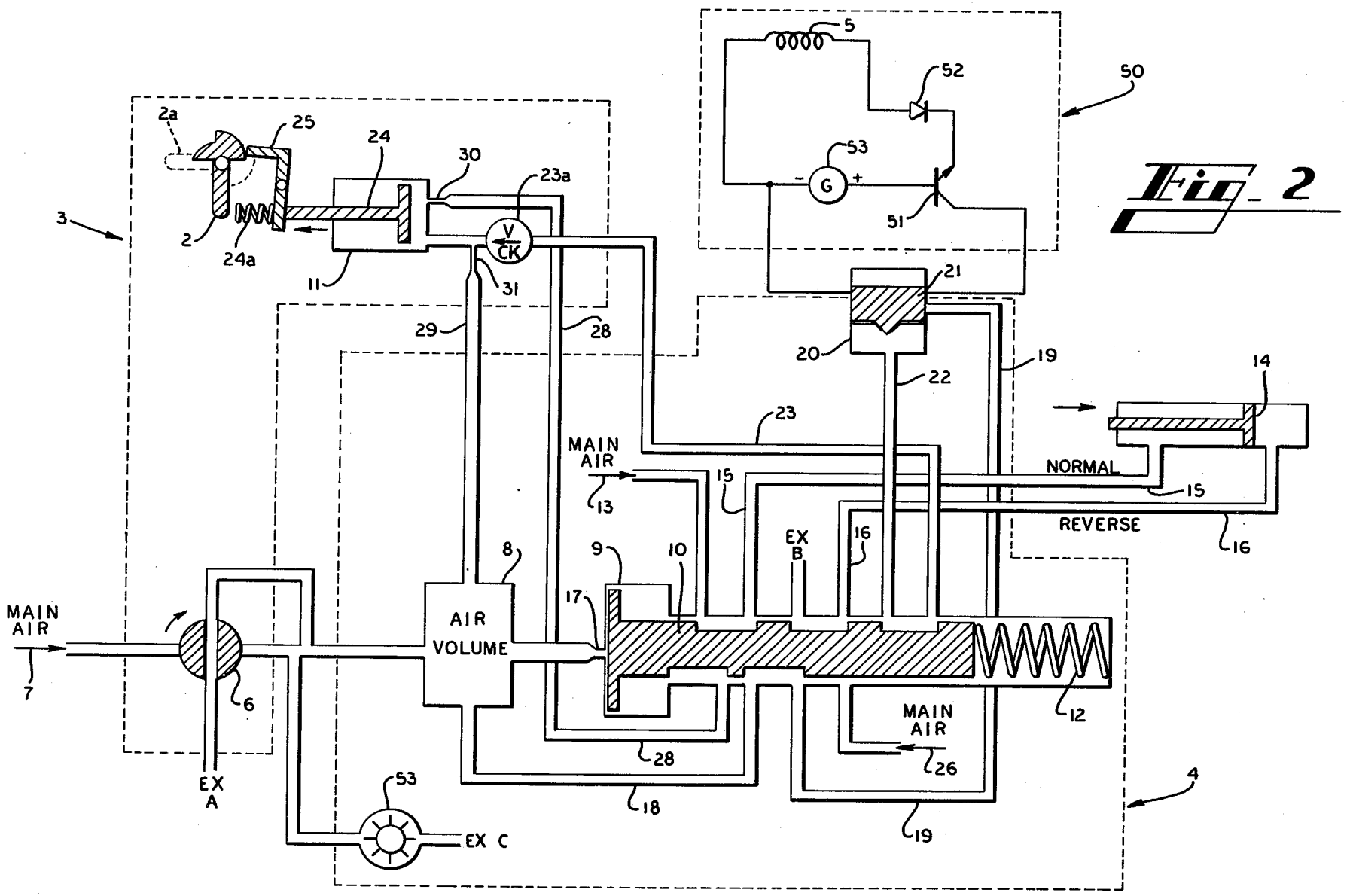
FIG. 2 is a schematic diagram showing the control system according to the present invention in its normal state.

The normal state of the system is shown in FIG. 2. The trip arm 2 is shown in the normal untripped position. In this position, air supply valve 6 is "closed" preventing flow of main air from inlet 7 into the air volume chamber 8 of the pneumatic control system 4. Exhaust port Ex A is connected directly to air volume chamber 8, thus exhausting all control air that might build up on the face of the control valve piston 10 and in the trip arm release valve 11. In this condition, the spring 12 located in the right hand end of the control valve 9 (as shown in FIG. 2) biases the control valve piston 10 to the left thus connecting the main air supply from inlet 13 to the normal side of the dump door ram 14 through a port in the control piston 10 and the normal control pipe 15. The reverse control pipe 16 at this time is connected to exhaust port Ex B through a port in the control valve piston 10. For this description, the normal position of the dump door ram keeps the hopper doors in the closed position.

As the hopper car moving along the tracks approaches the dumping area 42 (see FIG. 1), the downwardly extending trip arm 2 makes contact with the wayside latch tripping means 40 which places the trip arm in its tripped position *2a*. In the tripped position *2a*, air supply valve 6 is "opened" allowing air from the main air source entering at inlet 7 to pass into the air volume chamber 8 of the pneumatic control system 4. This allows pressure to build up on the face of the control valve piston 10 through choke 17. However, this build-up of air pressure will not overcome the pressure of spring 12 for fifteen seconds due to the effect of choke 17. During this time a check is made of the control devices to determine that the control circuit is not falsely energized by a breakdown of the solid state components of the electrical control system 50. Referring to FIG. 2, this check is made by connecting the inner volume chamber 8 through pipe 18, and through a port in the control valve 10 while in its normal position, that is to the left, to pipe 19 which is connected to the magnet valve chamber 20. If the magnet valve 21 is energized (in the "up" position shown by FIG. 3) due to a breakdown of the electrical components 50 or a false signal on the control pickup coil 5, or if the magnet valve 21 has failed in the energized (up) position, the air in pipe 19 will flow into pipe 22 through a port in the control valve 10, while in its normal position, to pipe 23, which is connected to the trip arm release valve 11. Air is prevented from flowing back through pipe 23 from trip arm release valve 11 by check valve 23*a*. This air pressure would force the trip arm release piston 24 to the left, releasing the mechanical latch 25 on trip arm 2. This arm being spring loaded, would return to its normal position thus closing air supply valve 6 and cutting off the main air pressure to the air volume chamber 8 and connecting this chamber to exhaust port Ex A. This would return the system to its normal state, thus accomplishing the fail safe preliminary check feature of this invention.

Figure 3:
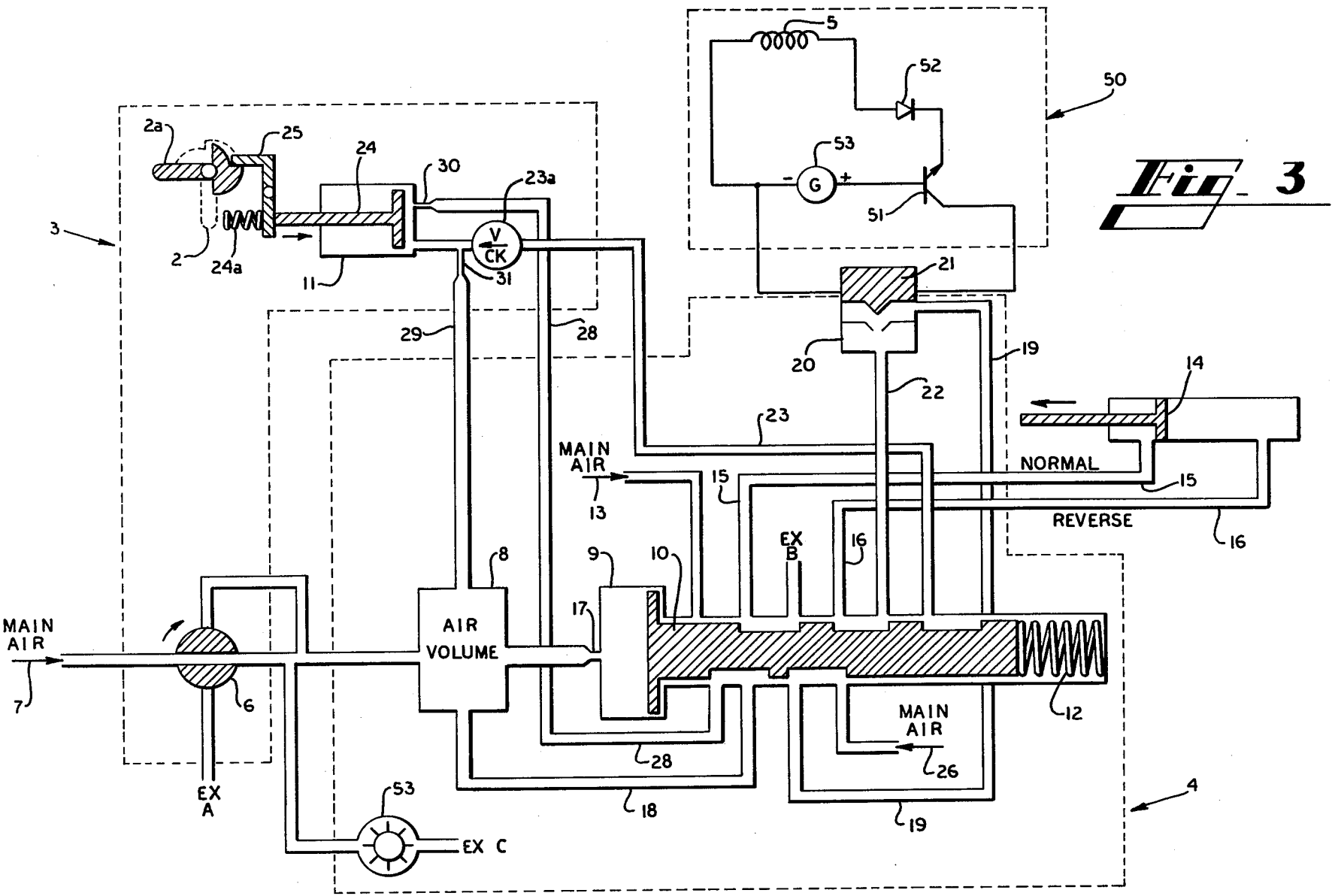
FIG. 3 is a schematic diagram showing the control system in its reverse or energized state.

However, if the magnet valve 21 is in the normal deenergized position (as shown in the drawing FIG. 2), when the downwardly extending trip arm 2 is engaged by and tripped by the wayside latch tripping means 40, the system will not be automatically shut off as previously described, but rather, air pressure building up on the face of the control valve piston 10 will overcome the pressure of spring 12 on the piston 10 and force the piston 10 to the right. Time lapse for this action will be approximately fifteen seconds as regulated by the restrictions of air choke 17. FIG. 3 shows this piston 10 forced to the right or door open position. With the control valve 10 in this position, the main air supply entering at inlet 13 has been cut off from the normal control pipe 15 and this pipe 15 is now connected to exhaust port Ex B through a port in the control valve 10. The reverse control pipe 16 is now connected to pipe 22 through a port in the control valve 10. Pipe 19 is now connected to main air pressure entering at inlet 26 through a port in the control valve 10.

Immediately after the fifteen second time lapse, the hopper car of FIG. 1 should be entering the dumping area 42 and pass by the wayside induction coil 41. As the induction pick-up coil 5 passes the wayside induction coil 41 the electrical control system 50 will become energized. The electrical control system will operate as follows. The pick-up coil 5 will work on the inductive principle and generate a voltage and current when it passes over the energized wayside coil or loop 41. This is accomplished by a signal of a tuned frequency. The current generated in the pick-up coil 5 will energize the trigger circuit of transistor 51 through diode 52. Diode 52 is in series with the transistor 51 trigger circuit to prevent feedback. This will put the transistor 51 into a conducting state and allow a current to pass through transistor 51 from the air generator 53 in order to energize the control valve magnet 21. This current will continue to flow until the air generator is cut off.

When the magnet valve 21 becomes energized as shown in FIG. 3, main air pressure will flow from pipe 19 to pipe 22 via the magnet valve port 20 and subsequently through a port in the control valve 10 to the reverse control pipe 16. This air pressure will then force the dump door ram to the reverse position (see FIG. 3) thus actuating a mechanical linkage to open the hopper car dump doors. No attempt will be made in this disclosure to explain this conventional mechanical linkage.

Cut-off of the main air supply at inlet 7 to the control valve piston 10 is accomplished by air pressure building up in the trip arm release valve 11. This air flows from the air volume chamber 8 to pipe 18 through a port in the control valve in its reverse position (see FIG. 3) to pipe 28 and also from the air volume chamber 8 to pipe 29. Both pipes 28 and 29 have chokes 30 and 31 limiting the flow of air to the trip arm release valve 11. The trip arm release valve 11 is biased by spring 24*a*. The combined air pressure from pipes 28 and 29 will overcome the pressure of spring 24*a* in thirty seconds and thus actuate the trip arm release valve 11. This will return the trip arm 2 to its normal untripped position. By returning the trip arm to its normal untripped position 2, the air supply valve 6 is closed. Air is exhausted from the air volume chamber 8 and the air generator through exhaust ports Ex A and Ex C. By exhausting air from the air volume chamber, spring 12 will eventually return the control valve piston 10 to its normal position, that is to the left. Main air will once again flow from inlet 13 through normal control pipe 15 to the dump door ram 14 thus once again closing the dump doors. Current from the air generator 53 being cut off will cause the transistor 51 to assume its nonconducting state.

Another fail safe feature of this device is the automatic trip arm reset provided by pipe 29. If the trip arm 2 is accidentally tripped to position 2*a*, for example, by hitting some obstruction on the track, and the hopper car is not in the vicinity of the dumping area and the magnet valve 21 is not energized nor stuck open, the control system will automatically return the trip arm 2 to its normal closed position. This is possible since by accidentally tripping the trip arm 2, air will flow through the opened air supply valve 6 into the air volume chamber 8. Air feeding from the air volume chamber 8 through pipe 29 will actuate the trip arm release valve 11 in sixty seconds as regulated by the choke 31. This fail safe feature will also act to close the trip arm 2 in a situation where the control valve 10 fails to attain the reverse position as shown in FIG. 3 due to some malfunction.

While this invention has been described in detail with particular reference to preferred embodiments thereof, it will be understood that variations and modifications can be effected within the spirit and scope of the invention as described hereinbefore and as defined in the appended claims.

I claim:

1. A method of controlling the dump door of a moving vehicle comprising the steps of:

moving the vehicle bearing a protruding trip arm along a predetermined path past a wayside latch tripping means, making contact between the trip arm and the latch tripping means to shift the trip arm from an untripped to a tripped position, charging a pneumatic control system with air in response to shifting the trip arm from its untripped position to its tripped position, changing the position of a first control valve in response to charging the pneumatic control system with air after a first predetermined time delay, moving the vehicle further along the predetermined path past a wayside magnetic field induction means, changing the position of a second control valve in response to the movement of the vehicle past the wayside magnetic field induction means, charging one side of a dump door ram with air in response to changing the positions both of the first and second control valves to shift the dump door from a first position to a second position, moving the trip arm from its tripped position to its untripped position after a second predetermined time delay after the dump door has been shifted from its first position to its second position to discharge the pneumatic control system, and charging the other side of the dump door ram with air to shift the dump door from its second position to its first position.

2. Method of claim 1 further including the steps of sensing the opened or closed position of the second control valve during the first predetermined time delay, and moving the trip arm from its tripped position to its untripped position in response to sensing that the second control valve is in its open position during the first predetermined time delay.

* * * * *